United States Patent [19]

Choi

[11] Patent Number: 4,896,831

[45] Date of Patent: Jan. 30, 1990

[54] UNDERFLOOR HEATING SYSTEM AND METHOD FOR HEATING THE SAME

[76] Inventor: Young T. Choi, 292-52, Imoon-Dong, Tongdaemoon-Ku, Seoul, Rep. of Korea

[21] Appl. No.: 220,001

[22] Filed: Jul. 15, 1988

[30] Foreign Application Priority Data

Aug. 12, 1987 [KR] Rep. of Korea ..... 8847/87[U]

[51] Int. Cl.[4] ..... F28F 7/00

[52] U.S. Cl. ..... 237/69; 165/53

[58] Field of Search ..... 237/69, 8 R; 165/47, 165/49, 53

[56] References Cited

U.S. PATENT DOCUMENTS 3,991,937 11/1976 Heilemann ..... 237/69 X 4,459,973 7/1984 Royer ..... 237/69 X

*Primary Examiner*—Henry A. Bennet

*Attorney, Agent, or Firm*—Flynn, Thiel, Boutell & Tanis

[57] ABSTRACT

A heating system for heating the floor of a room. The heating system includes an airtight sealed chamber directly beneath the floor which is to be heated. The top wall of the chamber is a concrete panel which also forms the floor which is to be heated. An electric heater or other type of incombustible heater source is provided in the chamber for heating the air therewithin. A heat diffusion plate is provided immediately above the heater to assist in the application of heat to the concrete panel.

6 Claims, 2 Drawing Sheets

UNDERFLOOR HEATING SYSTEM AND METHOD FOR HEATING THE SAME

BACKGROUND OF THE INVENTION

The present invention relates to an underfloor heating system for heating the floor of a room and its heating method. The underfloor heating system is very simple in construction and very low in construction cost. The underfloor heating system can be constructed in a short period of time. Further, it prevents air pollution and it maximizes heating effect as a heating means to be used not only for traditional Korean type or built rooms but also for all types of structures, such as office buildings, exhibition halls and public assembly rooms. In addition, and by use of night time generated electric power, much heat of a panel is regenerated heat, and then can be radiated heat on the panel during the daytime.

As to the traditional underfloor heating system of a room, stone slabs are installed on the upper part of flues in a hypocaust connected with a fuel hole and a chimney to be heated up directly by the burning fuel. Although physical human body treatment and heating effect are good by the radiation of infrared rays as those stone slabs are heated directly by the flames, it is still defective because thermal loss is great as a lot of thermal energy is drawn off from the fuel hole and chimney when a fire is not kindled and harmful gas is released into the air.

In the case of a hot water circulation-type underfloor heating system, there is required a lot of thermal energy for heating water as it uses water for distribution of heat. It is unable to produce the intended effect due to low heat distribution speed and local radiation. Moreover, as it collects the remaining heat entirely into its boiler, thermal efficiency is extremely bad due to a lot of thermal loss caused during the distribution of heated water. Nevertheless, installation expense and maintenance cost are excessive. As the radiation part of the concrete panel is small, heat is not stored. As relatively high-temperature thermal energy is radiated, thermal energy is quickly sent directly to the region underneath the ceiling. When the ceiling is high in temperature and the floor is cold, an undesirable heating effect for the human body is thereby produced.

Regarding the steam-type heating system, it releases intense heat from a limited part and hot air goes up toward the ceiling rapidly. In order to obtain the desired effect below 130 to 170 cm which is the height about that of a nose from the floor of a room, it requires an enormous amount of thermal energy. In such a case, an amount to be borne for purchasing holed briquets, oil or gas including transportation costs and a space to be occupied by such fuel are not inconsiderable. In case holed briquets are used, it involves a problem of disposing of briquet cinders and air pollution caused by harmful gas and briquet cinders presents such a serious problem that the dwelling environment is extremely unhygienic. In order to install such heating systems as described hereinabove, it not only requires a considerable amount of manpower but also wastes construction expenses, time and resources. It is impossible to install it in a high-rise building because the load thereof is so great. Its thermal efficiency is extremely low as compared with investment.

In order to solve such problems as described hereinabove, the present inventor filed a Korean application No. 85-923 for a patent. It aimed at producing heat isolation effect by removing a tamping layer and forming an airtight vacuum part between the floor and concrete panel. Although it is advantageous that the construction period can be substantially shortened by its simple process, materials be made minimal, it can be installed in a high-rise building by the minimization of load and the concrete panel itself can produce the uniform radiation effect, it is still defective because it requires the arrangement of water circulation pipes for the distribution of heat and it is consequently unable to obviate a defect caused by the use of water as a distributor of heat.

In order to eliminate such a defect as contained in the prior application, a so-called air heating system in which air is circulated as a heat distributor instead of water was devised. According to this device, an airtight vacuum cavity was formed between the floor and the concrete panel and air heated by a heat exchanger was forced to circulate in the said cavity to heat up the concrete panel. In this case, as the heated air circulates in the airtight circulation circuit, thermal loss was relatively small and the heating effect was thereby improved. At the same time, the device could obtain a uniform radiation effect and prevent the discharge of harmful gas. As the heat exchanger and circulation pump were operable by the use of home electricity, the problem involved in the purchase and storage of fuel and in the disposal of waste could be improved. However, as the heat exchanger, air circulation pipes and circulation pump had to be installed, installation expense was high, requiring a certain space. In particular, the loss of heated air caused by coming into contact with the open air while circulating through circulation pipes and heat exchanger, if kept warm, could not be eliminated completely.

The present invention is a device which aims to use the merits of the traditional underfloor heating system, developing more efficiently the invention for which a Korean application was filed previously. An explanation thereof according to the drawings attached hereto will be given hereunder.

DETAILED DESCRIPTION

Figure 1:
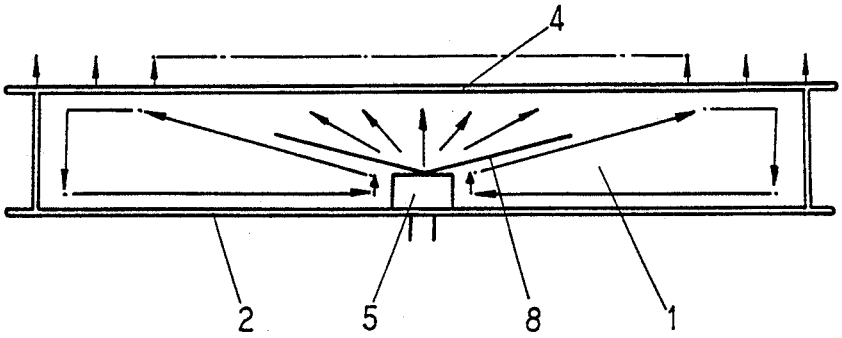
FIG. 1 is a detailed view showing the principle of the underfloor heating system embodying the present invention.
Figure 2:
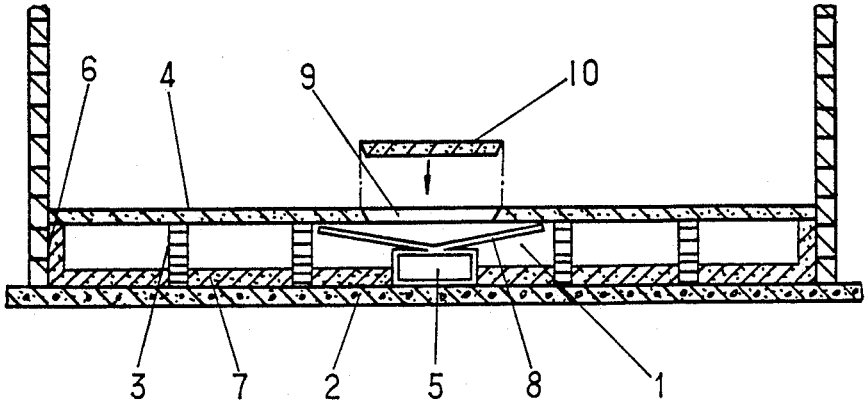
FIG. 2 is a sectional view of FIG. 1.
Figure 3:
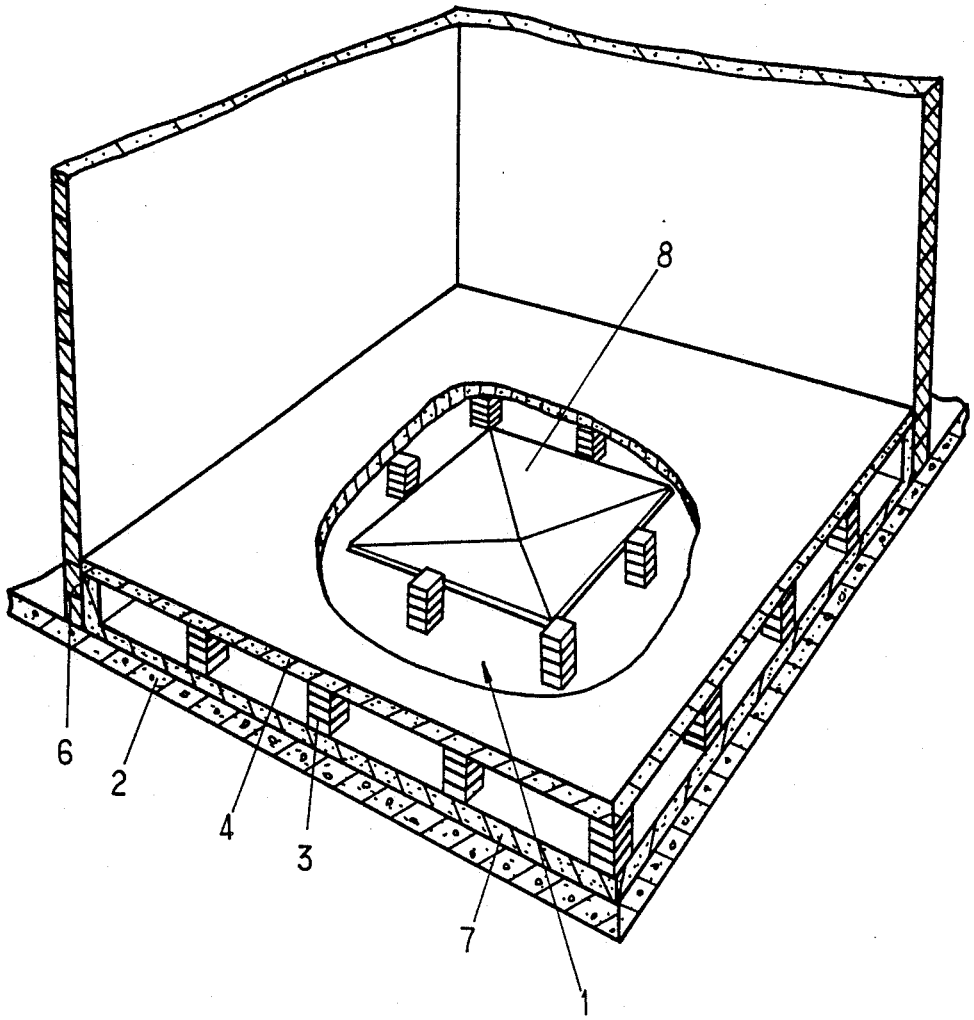
FIG. 3 is a partially, cutaway perspective view of the underflow heating system embodying the present invention.

In the drawings attached hereto, 1 is an airtight cavity which comprises plural upstanding support columns 3 made to stand on a bottom support surface 2 of airtight cavity. The support columns support a concrete panel covered on it. An incombustible heat source 5 is installed in the proper region of this airtight cavity 1 and an adiabatic layer 7 is elaborately set up on the bottom surface 2 of the airtight cavity and on the side wall 6. 8 is a hot air diffusion plate installed on the incombustible heat source (electric heater) 5. It diffuses the hot air generated in the heat source 5 to heat up the concrete panel 4 uniformly. As shown in FIGS, 2 and 3, the plate 8 includes a central portion adjacent the heat source 5, a vertically offset peripheral portion adjacent the concrete panel 4, and an inclined intermediate portion extending therebetween. 9 is an opened part bored in the concrete panel 4 immediately above the diffusion plate 8. A cover 10 is fixedly inserted in this opened part 9.

Giving an explanation of the working principle and effect of the present invention constituted in this manner, it comes as follows:

The present invention shortens to a minimum the distance between heat source 5 and concrete panel 4 by having a heat source built-in underneath the concrete panel of a heat-requiring room and removes the thermal energy loss caused during distribution by the use of air as a thermal energy distributor. That is, the air, which is a thermal energy distributor, is mixed with nitrogen (80%), oxygen (18%) and others such as carbon dioxide ($CO_2$) and steam. Its thermal capacity amounts to ¼ of water, but its expansion according to a temperature change is sensitive and molecules of each gas contained in the air will move faster and the speed of electrons contained in the molecule will naturally become faster. The academic world presumes that reaction to gas is by the electrons.

Accordingly, the air physically heated by the heat source 5 will rapidly rise for proper distribution to the concrete panel 4 from the heat diffusion plate 8. It heats up the concrete panel 4 uniformly and then returns cooled and contracted to the heat source 5 by convection.

At this juncture, the heat diffusion plate 8 also heats up the concrete panel 4 by discharging radiant heat. As the heat source 5 itself is in the airtight cavity 1, its thermal efficiency achieves the highest level without thermal loss. The airtight cavity 1 will result in a thermal pocket as time goes by.

On the other hand, as the heated concrete panel 4 accumulates heat almost equally to the temperature right thereunder by means of thermal conduction, heat will be radiated from the entire concrete panel 4 (namely, from the upper surface of the concrete panel 4) and the radiated heat will slowly rise and uniformly maintain the level and vertical distribution of room temperature.

As the present invention accumulates heat by applying it to the concrete panel 4 and radiates it uniformly, it will not suddenly change the room temperature and produce a great effect even by a low temperature of about 30° C. of the upper surface of concrete panel. As compared with the method in which hot air rises suddenly and heats up the region underneath the ceiling like the steam heating system which supplies steam hotter than 100° C. or pipe-arranged ondol (hot floor) system which supplies 60 to 70° C. water, the air heated at a low temperature will constantly and slowly rise from the concrete panel 4, thereby distributing the room temperature in a desirable manner. As the heated air uniformly rises from the entire surface of concrete panel 4, it naturally runs against descending cooled air and its rising speed becomes slow, thereby making a convective phenomenon present itself in a slow fashion. Thus, room temperature is kept constant and uniform by applying heat to the concrete panel and by accumulating the applied heat and radiating the accumulated heat.

As described hereinabove, the present invention comprises an airtight cavity 1 between the bottom support surface of the airtight cavity and concrete panel 4 and installs an incombustible heat source 5 in the proper region of an airtight cavity 1. An adiabatic layer 7 is provided on the bottom support surface 2 of the airtight cavity 1 and on the side walls 6. A heat diffusion plate 8 is provided just above the incombustible heat source 5. As it uses air as a distributor of heat in the airtight cavity 1, it applies heat and conveys and radiates the applied heat without loss. Moreover, it discharges no harmful gas into the air and is so simple in structure that materials, construction period and labor can be reduced to a minimum. In particular, it effects radiation of heat from the concrete panel 4 so uniformly that a comfortable space can be formed by the control of convective circulation. In short, the present invention is an epoch-making device in terms of economical efficiency achieved without thermal loss.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which as exclusive property or privilege is claimed are defined as follows:

1. An underflooring heating system structure, comprising:

bottom support means defining a bottom support surface, an upstanding wall means, a concrete panel spaced a finite distance above said bottom support surface and being supported on at least one of said bottom support means and said wall means to define a sealed airtight cavity between said concrete panel and said bottom support surface, said concrete panel forming a top wall of said cavity, said also forming an underfloor of a room, interior surfaces of aid wall means having an insulating layer thereon, said concrete panel having an opening therethrough with a cover member fixed therein;

a noncombustible heat source for generating hot air in said cavity being arranged on said support surface in said cavity and having a heat diffusion means mounted thereon for diffusing the hot air generated by said heat source to uniformly heat said concrete panel, said heat source being located in said cavity such that said heat diffusion means is under said opening in said concrete panel and covered by said cover, said heat source being connected to an electric energy source, whereby said concrete panel is heated by convection and radiant heat by said heat source within said cavity under said underfloor.

2. A method for heating the underflooring of a room by an underfloor heating system comprising the steps of:

uniformly heating a concrete floor panel, which panel forms part of the underflooring, utilizing regenerated heat and radiated heat with higher heat produced by a noncombustible heat source disposed in a sealingly airtight cavity defined below and covered by said concrete panel, said heat source being adapted to produce infrared radiation and utilize air as a heat transfer medium with said cavity under the underflooring;

heating and storing heat in said concrete panel by said heat source with radiated heat, and using air within said cavity as a heat transfer medium, and then warming said room for a long time period, nearly without any heat loss, by radiating heat in all of the surface of said panel slowly, even through said heat source is inoperative during said time period.

3. The underflooring heating system structure according to claim 1, wherein said heat diffusion means includes a heat diffusion plate having a central portion, a peripheral portion, and an intermediate portion between said central and peripheral portions, said heat diffusion plate being arranged in said cavity such that said central portion overlies aid heat source, said peripheral portion and said central portion being vertically offset from each other such that said intermediate portion inclines toward said concrete panel as it extends from said central portion toward said peripheral portion.

4. The underflooring heating system structure according to claim 3, wherein said peripheral portion defines a peripheral edge of said heat diffusion plate, and wherein said peripheral edge is substantially rectangularly shaped.

5. The underflooring heating system structure according to claim 4, wherein said peripheral edge of said heat diffusion plate is disposed adjacent said concrete panel.

6. The underflooring heating system structure according to claim 1, wherein said opening in said concrete panel is centrally located therein so as to be centrally located above said cavity.

* * * * *

UNITED STATES PATENT AND TRADEMARK OFFICE

CERTIFICATE OF CORRECTION

PATENT NO. : 4 896 831

DATED : January 30, 1990

INVENTOR(S) : Young Taik CHOI

It is certified that error appears in the above-identified patent and that said Letters Patent is hereby corrected as shown below:

Column 4, line 35; after "said" (second occurrence) insert ---concrete panel---.

Column 4, line 37; change "aid" to ---said---.

Column 4, line 62; change "with said" to ---within said---.

Column 5, line 1; change "through" to ---though---.

Column 5, line 9; change "aid" to ---said---.

Signed and Sealed this

Twenty-sixth Day of March, 1991

*Attest:*

*Attesting Officer*

HARRY F. MANBECK, JR.

*Commissioner of Patents and Trademarks*